US006862910B2

(12) United States Patent
Amborn

(10) Patent No.: US 6,862,910 B2
(45) Date of Patent: Mar. 8, 2005

(54) METHOD OF MANUFACTURING A HOLLOW METAL BODY

(76) Inventor: Peter Amborn, In den Gäerten 2, D-53819 Neunkirchen (DE)

( * ) Notice: Subject to any disclaimer, the term of this patent is extended or adjusted under 35 U.S.C. 154(b) by 0 days.

(21) Appl. No.: 10/410,013

(22) Filed: Apr. 9, 2003

(65) Prior Publication Data

US 2003/0209046 A1 Nov. 13, 2003

(30) Foreign Application Priority Data

May 8, 2002 (DE) ..... 102 20 429

(51) Int. Cl.[7] ..... B21D 9/18; B21D 26/02

(52) U.S. Cl. ..... 72/62; 72/61; 72/342.7; 72/342.97; 29/421.1

(58) Field of Search ..... 72/58, 60, 61, 72/62, 342.7, 342.97; 29/421.1

(56) References Cited

U.S. PATENT DOCUMENTS 5,481,892 A * 1/1996 Roper et al. ..... 72/61
5,992,197 A * 11/1999 Freeman et al. ..... 72/62
6,322,645 B1 * 11/2001 Dykstra et al. ..... 72/62
6,401,509 B1 6/2002 Amborn

FOREIGN PATENT DOCUMENTS

DE 29 41 972 A1 10/1979
DE 29 41 972 10/1979
DE 199 44 679 9/1999

* cited by examiner

*Primary Examiner*—David B. Jones
(74) *Attorney, Agent, or Firm*—Jordan and Hamburg LLP

(57) ABSTRACT

The subject matter of the present invention is a method of manufacturing, in a tool mold provided with a final contour as desired, a hollow metal body the cross-sectional shape of which varies in the longitudinal direction, an internal pressure being applied to a tubular hollow body with approximately uniform initial wall thickness, the tubular hollow body having the highest temperature in the zones of greatest deformation, the temperature in these zones being reduced once the hollow body fits against the wall of the tool mold, the temperature being subsequently increased in zones with lower degrees of deformation.

12 Claims, 1 Drawing Sheet

METHOD OF MANUFACTURING A HOLLOW METAL BODY

FIELD OF THE INVENTION

The present invention relates to two methods of manufacturing, in a tool mold provided with a final contour as desired, a hollow metal body the cross-sectional shape of which varies in the longitudinal direction, an internal pressure being applied to a tubular hollow body with approximately uniform initial wall thickness.

DESCRIPTION OF THE PRIOR ART

A method of the type mentioned herein above is known from DE 29 41 972 for example. The tubular blank made from aluminum/magnesium is heated in the zone to be formed to a temperature in excess of 500° C., the pressure means, a gas for example, being heated to at least 500° C. as well in order to facilitate the flow of material into the contour of the tool mold during the forming process. For steel, the document teaches a temperature of approximately 800° C. This process, which is known by the name of "hydroforming", only permits soft transitions between the diameters of the various cross-sectional shapes to be formed, material having to be fed by compression in order to achieve an approximately uniform wall thickness. Steep transitions can only be achieved by reducing the initial wall thickness; for only soft transitions toward greater circumferences reliably prevent laps, irregularities or folds from forming on the hollow metal body at the axial pressures required. This means that, with the prior art method, it is possible either to deform to a lesser extent with steep transitions and with feeding of the corresponding amount of material, or to deform to a greater extent with smooth transitions, the material being also fed in a sufficient amount.

A method is known from DE 199 44 679.2-14 by which the tube is compressed during the forming process, the blank in the tool having a higher temperature in the zone that is to be deformed to a greater extent during the forming process than in the zone that is to be subjected to a lesser degree of deformation. Accordingly, the temperature of the blank depends on the extent of the respective deformation. The higher temperature increases the overall extensibility of the material, meaning that, as the two tube end portions are pushed together, the material flows at a faster rate in this zone, thus filling the mold faster than in other zones in which the cross-sections of the transitions are less steep and less protruding.

It has been found though that, under low internal pressure, folds or laps may form under certain conditions on the hollow body as the material is being fed in the axial direction.

BRIEF SUMMARY OF THE INVENTION

The invention discloses two variants of a method for manufacturing a hollow metal body of the type mentioned herein above by means of which the formation of folds, laps and other unwanted effects can be avoided.

According to a first variant, there is provided that the tubular hollow body has the highest temperature in the zones of greatest deformation, the temperature in the zones of greatest deformation being reduced once the hollow body fits against the wall of the tool mold, the temperature being subsequently highest in the adjacent zones with lower degrees of deformation until the hollow body contacts the tool mold again. The same occurs next in a continuous manner with the other adjacent regions in the direction of the zones of lower degrees of deformation until the entire hollow body is conformed to the contour of the tool mold. Meaning, the forming process is sequential, i.e. it takes place from zones of greater deformation toward zones of lower degrees of deformation with the appropriate temperatures being provided during the forming process. The important point is that the thickness of the hollow body's wall is selected at the beginning of the forming process in such a manner that after deformation the desired wall thickness is obtained.

Further advantageous features are apparent from the subclaims.

It is obvious from the teaching of claim 1 that the zones of the hollow body subjected to greater deformation are formed first as the high temperatures prevail there. In these zones of great deformation, the material is reduced in cross section because it is deformed to a great extent. The risk of fold formation in this zone is small as the zones adjacent to this zone, which have a low or a lesser degree of deformation or forming degree, are relatively cooler and as deformation is accordingly continuously reduced toward the end portions. As a result thereof, the material in the zone of great deformation is subjected to a tensile load during the forming process. The initial deformation of the blank should extend along the length of the blank with greater deformation in such a manner that a kind of long bubble with a continuous transition is obtained. To avoid the formation of laps and folds, the temperature of the zones at the tube end portions is to be designed in such a manner that said end portion zones do not deform, not even under the action of the highest internal pressure occurring during the forming process, to maintain the tensile load. Final forming in the zones of low degrees of deformation rather takes place only after either the temperature through subsequent heating or the internal pressure has been increased accordingly there. The forming process in the end zones also takes place when the material has flown from said zones of low degrees of deformation into zones of greater deformation and after the workpiece has cooled down in the zones of greater deformation through contact with the wall of the tool. This means that, viewed in the axial direction, the workpiece always has a tensile stress component in the discrete segments thereof during deformation. As the material is subjected to a tensile load during the various successive steps of the forming process, folds are prevented from forming. The method of the type mentioned herein above can be performed provided that the tubular hollow body blank has a certain minimum wall thickness, said wall thickness being determined to be at a certain ratio to the degree of deformation required.

According to a particular embodiment of this method, there is provided that, in order to achieve an approximately uniform wall thickness in the zones of low degrees of deformation along the length of the hollow body subjected to an internal pressure during the forming process, the hollow body is subjected to a tensile load in the axial direction. It is thereby taken into consideration that less material is needed in the zones subjected to low degrees of deformation. If this were not considered, the material constituting the wall thickness would be thinner in the zones of greater deformation than in the zones of less deformation, which, in certain cases, is not desirable. Accordingly, in order to still obtain a workpiece having substantially uniform wall thickness along the length thereof, it is suggested to subject the workpiece to tension in the axial direction while forming the workpiece in the zone of lower degrees of deformation in order to remove from this zone material that is actually not needed for the forming process if one wants to achieve uniform wall thickness along the length of the hollow body.

In view thereof the hollow body must be sealed at its end in such a manner that tensile loads may be transmitted while the internal pressure is being maintained.

The same applies when the hollow body is compressed. As the body is being compressed during the forming process, it has to be made certain that the force component generated by the internal pressure in the material is always greater than the axial pressure component during compression in order to prevent laps from forming.

After completion of the forming process, the temperature of the overall workpiece can be increased in order to form the hollow body to size or to avoid the "orange peel" effect on light metals. For light metals, the temperature should then preferably range from 500 to 550° C., for forming steel to size, it should be in excess of 900° C. and to avoid the "orange peel" effect, it is possible to increase the internal pressure accordingly.

The second variant of a method of manufacturing a hollow metal body of the type mentioned herein above is characterized in that a higher temperature is provided for in the zones of greater deformation than in the zones of lower degrees of deformation, the temperature in the zones of greater deformation and in the zones of lower degrees of deformation being selected so that the forming rate in the discrete zones is such that the forming process is completed almost simultaneously in all the zones of the hollow body.

It has been assumed that zones of the hollow body having an increased temperature start flowing somewhat earlier and also faster than zones with a lower temperature. Assuming that the temperature applied to the workpiece is substantially higher in zones of greater deformation than in the zones of lower degrees of deformation, the material will, at appropriate internal pressure, flow much faster in the zone of greater deformation than in the zone of lower degrees of deformation so that, if the temperatures are suitably chosen, the material will form on the wall of the tool mold almost simultaneously. Then, the temperature of the overall workpiece can be increased as well for the purpose of forming it to size and of avoiding the "orange peel" effect that may occur with light metals due to the increase in temperature. With light metals, the temperature should then range from 500 to 550° C., with steel, it should be in excess of 900° C.

Again, the most important consideration is that the deforming material is subjected to a tensile load. Thus, the initial wall thickness is not substantially reduced and the undesirable effects of the formation of folds is avoided.

The forming process may also be performed under tensile load in the axial direction, the initial wall thickness being considerably reduced in this case so that enough thickness must be provided for. Again, the hollow body can be compressed in the various zones of deformation during the forming process. Then, in order to avoid the formation of laps and folds, compression is to be carried out in such a manner that the internal pressure component generated by the gas be greater than the axial pressure component occasioned by compression. This means that a residual tensile load component generated by the deformation that took place under the action of the internal pressure must prevail.

The invention is explained herein after in closer detail by way of example with reference to the drawing.

DETAILED DESCRIPTION OF THE INVENTION

Figure 1:
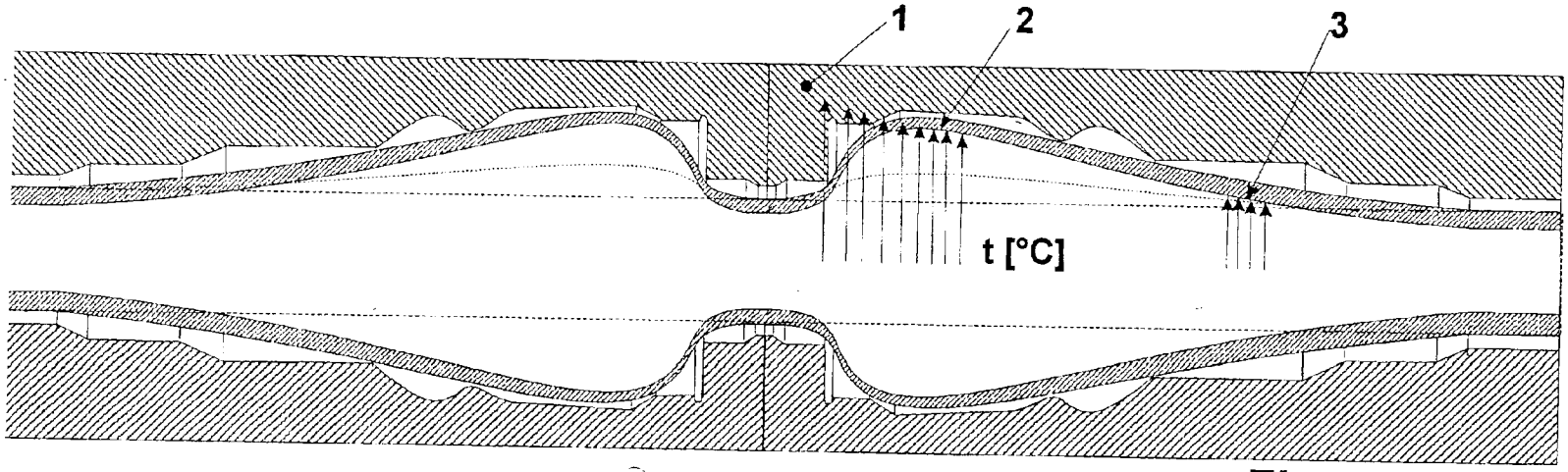
FIG. 1 shows a double tool mold, the two sides of said tool mold being mirror-inverted and the hollow body placed in the tool mold having a thickness that varies along the length thereof after it has undergone deformation.
Figure 2:
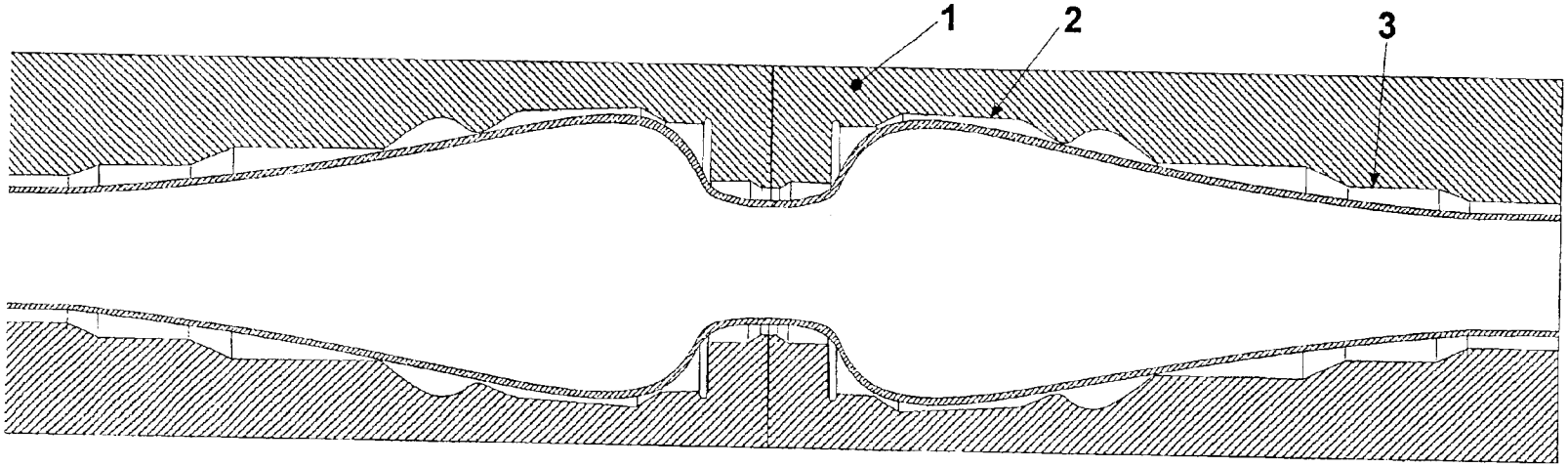
FIG. 2 shows a view according to FIG. 1, the hollow body placed in this tool mold having a substantially uniform wall thickness.

The tool mold labelled at 1 has zones of greater deformation and zones of lower deformation degrees. The zone of great deformation is indicated by the arrow 2 and the zone of a lower deformation degree by the arrow 3. The zones therein between undergo mean degrees of deformation. In the zone of the arrow 2, meaning in the zone of great deformation, the temperature—marked by several arrows—is substantially higher than in zone 3 of lower degrees of deformation, the temperature gradient in the zone between the zones 2 and 3 corresponding to the deformation degree this zone is subjected to. FIG. 1 describes the method according to the first variant, the temperature being higher in the zone of great deformation than in the zone of lower degrees of deformation—in a manner very similar to that shown in the illustration of FIG. 1. Since no axial pressure is made use of here, the wall thickness will be reduced in the zone of great deformation, meaning in zone 2. This means that the wall thickness is smaller in the zone indicated by arrow 2 than in the zone indicated by arrow 3. In order to still achieve the same wall thickness along the length of the hollow body there is provided to now exert a tensile load on the hollow body in the axial direction, the temperature in the zone indicated by arrow 2 being lower than in the zone indicated by arrow 3 while the hollow body is subjected to this tensile load so that the material lengthens in the zone indicated by the arrow 3 and may thus be adjusted to a wall thickness corresponding to that of zone 2. Again, the important point is that the whole hollow body be in principle always under tensile load in order to avoid the formation of folds.

In order to avoid, with this temperature distribution at a corresponding internal pressure, the formation of folds according to the second embodiment, the amount of material fed by axial pressure to the zone of greatest deformation is just enough to always ensure the formation of a "bubble" with soft transitions. As the zone of great deformation is being formed, the axial pressure is maintained, although decreasing as the deformation process evolves, until the hollow body is subjected to a tensile load as a result of the deformation taking place in the neighboring zones with lower degrees of deformation (embodiment 2). The hollow body thus obtained has the contour of the tool mold and the wall thickness is substantially uniform along the entire length of the hollow body.

I claim:

1. A method of manufacturing a hollow metal body having a cross-sectional shape which varies in a longitudinal direction, comprising the steps of:

providing a tool mold having a desired final contour;

disposing a tubular hollow body having an approximately uniform wall thickness in said tool mold;

applying an internal pressure to the tubular hollow body such that the tubular hollow body forms an extended bubble with gentle transitions during expansion and the bubble has a largest size in a region of a greatest degree of deformation;

heating the tubular hollow body to a highest temperature in zones of greatest deformation;

reducing the temperature in the zones of highest deformation once the hollow body fits against an inner wall of the tool mold such that the temperature is subsequently highest in adjacent zones with lower degrees of deformation until the hollow body again contacts the inner wall of the tool mold; and applying a tensile stress axially to the hollow body during deformation in individual sections of having different degrees of deformation.

2. A method of manufacturing a hollow metal body having a cross-sectional shape which varies in a longitudinal direction, comprising the steps of:

providing a tool mold having a desired final contour;

disposing a tubular hollow body having an approximately uniform wall thickness in said tool mold;

applying an internal pressure to the tubular hollow body such that the tubular hollow body forms an extended bubble with gentle transitions during expansion and the bubble has a largest size in a region of a greatest degree of deformation;

heating the tubular hollow body to a higher temperature in zones of greater deformation than in zones of lower degrees of deformation such that the forming rate in the zones is such that forming is completed almost simultaneously in all the zones of the hollow body.

3. The method of manufacturing a hollow metal body according to claim 1 or 2, wherein the hollow body is compressed during forming such that a force component of material of the hollow body is generated by the material greater in the axial direction than an axial pressure component generated by the compression process.

4. The method of manufacturing a hollow metal body according to claim 3, wherein the hollow body is compressed in a zone of highest deformation during forming in order to feed material.

5. The method of manufacturing a hollow metal body according to claim 1 or 2, wherein during forming various zones of the hollow body are shaped to the final contour desired in said zones by means of subsequent heating.

6. The method of manufacturing a hollow metal body according to claim 1 or 2, wherein during forming the hollow body is shaped to the final contour desired by gradually increasing the internal pressure.

7. The method of manufacturing a hollow metal body according to claim 1 or 2, during expansion the hollow body always forms an elongate bubble with soft transitions and that the bubble has a greatest circumference in a zone of greatest deformation.

8. The method of manufacturing a hollow metal body according to claim 1 or 2, during forming the hollow body progressively fits on the inner wall of the tool mold starting from a center of the tool mold or from a site of greatest deformation of end portions the hollow body so that no friction occurs between the tool mold and the hollow body and no lubricant is needed as a result thereof.

9. The method of manufacturing a hollow metal body according to claim 1 or 2, wherein during forming end portions of the hollow body remain so cold that they do not deform and are free to move in the axial direction within the tool mold irrespective of an increase in the internal pressure or in the temperature in the zones to be formed in order to allow the tensile loads occurring in the zones being formed to cause the material to flow.

10. The method of manufacturing a hollow metal body according to claim 1 or 2, wherein the expansion on account of the contour of the tool mold is dimensioned in such a manner that heating intended for expansion takes into account the forming temperature of the hollow body.

11. The method of manufacturing a hollow metal body according to claim 1 or 2, wherein to remove the hollow body from the tool mold, said hollow body is cooled down from inside in order to facilitate the removal thereof from the mold.

12. The method of manufacturing a hollow metal body according to claim 12, wherein cooling down is obtained by means of gases or liquids that are introduced into the hollow body.

* * * * *